US009728048B2

(12) United States Patent
Saunders

(10) Patent No.: US 9,728,048 B2
(45) Date of Patent: Aug. 8, 2017

(54) MATCHED SYMBOL UPGRADE SLOT GAME

(71) Applicant: IGT, Las Vegas, NV (US)

(72) Inventor: Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 350 days.

(21) Appl. No.: 14/033,274

(22) Filed: Sep. 20, 2013

(65) Prior Publication Data

US 2015/0087383 A1 Mar. 26, 2015

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC .... G07F 17/329; G07F 17/34; G07F 17/3213; G07F 17/3244; G07F 17/326; A63F 3/06; A63F 3/0605; A63F 3/061; A63F 3/062; A63F 3/0645; A63F 3/08; A63F 3/081
See application file for complete search history.

(56) References Cited

U.S. PATENT DOCUMENTS 4,856,787 A * 8/1989 Itkis ..... G07F 17/32 273/237
5,833,537 A * 11/1998 Barrie ..... G07F 17/3265 463/21
5,980,384 A * 11/1999 Barrie ..... G07F 17/3265 273/138.1
6,159,095 A * 12/2000 Frohm ..... G07F 17/32 273/269
6,203,428 B1 * 3/2001 Giobbi ..... G07F 17/32 463/13
6,315,291 B1 * 11/2001 Moody ..... A63F 3/065 273/139
6,334,814 B1 1/2002 Adams
6,346,043 B1 2/2002 Colin et al.
6,364,313 B1 * 4/2002 Moody ..... A63F 3/065 273/138.1
6,398,645 B1 * 6/2002 Yoseloff ..... G07F 17/34 273/269
6,554,703 B1 4/2003 Bussick et al.
6,632,139 B1 10/2003 Baerlocher
6,652,378 B2 * 11/2003 Cannon ..... G07F 17/32 463/20
6,656,040 B1 * 12/2003 Brosnan ..... G07F 17/3262 273/121 B (Continued)

*Primary Examiner* — David L Lewis
*Assistant Examiner* — Matthew D. Hoel
(74) *Attorney, Agent, or Firm* — Neal, Gerber & Eisenberg LLP

(57) ABSTRACT

Methods and systems providing game play of a slot game allowing for identifying matching symbols in the same relative positions in two or more grids. A first grid and a second grid may be displayed. Symbols for each grid spot in the first and second grids are determined, and the display of the game is updated with the determined symbols. A first symbol in a first location in the first grid is determined to match a second symbol in a second location in a second grid, where the first location and the second location are the same relative positions in the first grid and the second grid. An award to a player is determined based on the determined match.

23 Claims, 5 Drawing Sheets

(56) References Cited

U.S. PATENT DOCUMENTS 6,669,559 B1 12/2003 Baerlocher et al.
6,682,419 B2 * 1/2004 Webb ..... G07F 17/32 273/148 B
6,746,328 B2 6/2004 Cannon et al.
6,749,502 B2 6/2004 Baerlocher
6,769,982 B1 8/2004 Brosnan
6,832,957 B2 * 12/2004 Falconer ..... G07F 17/34 463/20
6,837,788 B2 1/2005 Cannon
6,855,053 B2 2/2005 Baerlocher
6,939,229 B2 9/2005 McClintic
6,964,416 B2 11/2005 McClintic et al.
7,040,983 B2 5/2006 Dolloff et al.
7,056,192 B2 6/2006 Venigalla et al.
7,128,646 B2 10/2006 Baerlocher et al.
7,252,591 B2 8/2007 Van Asdale
7,341,512 B2 3/2008 Dolloff et al.
7,399,226 B2 7/2008 Mishra
7,399,227 B2 7/2008 Michaelson et al.
7,448,948 B2 11/2008 Hughs-Baird et al.
7,470,186 B2 12/2008 Cannon
7,513,828 B2 4/2009 Nguyen et al.
7,553,230 B2 6/2009 Cannon
7,682,241 B2 3/2010 Baerlocher
7,758,416 B2 7/2010 Randall
7,850,522 B2 12/2010 Walker et al.
7,874,908 B2 1/2011 Walker et al.
7,901,282 B2 3/2011 Cannon
8,016,657 B2 9/2011 Walker et al.
8,025,561 B2 9/2011 Reddicks et al.
8,070,587 B2 12/2011 Davis et al.
8,109,821 B2 * 2/2012 Kovacs ..... G07F 17/3211 463/16
8,113,939 B2 2/2012 Cannon
8,128,478 B2 3/2012 Meyer
8,157,633 B2 4/2012 Kaminkow
8,277,302 B2 10/2012 Walker et al.
8,333,657 B1 12/2012 Nelson et al.
8,388,435 B2 3/2013 Anderson et al.
8,403,740 B2 3/2013 Kovacs et al.
8,408,990 B2 4/2013 De Waal et al.
8,449,390 B2 5/2013 Kaminkow
8,500,538 B2 8/2013 Warner et al.
8,512,120 B2 8/2013 Nelson et al.
8,932,126 B2 * 1/2015 Nguyen ..... G07F 17/34 463/20
2002/0183105 A1 * 12/2002 Cannon ..... G07F 17/32 463/16
2003/0060268 A1 * 3/2003 Falconer ..... G07F 17/34 463/20
2006/0073886 A1 * 4/2006 Tempest ..... G07F 17/32 463/27
2008/0102952 A1 5/2008 Walker et al.
2008/0161094 A1 * 7/2008 Tempest ..... G07F 17/32 463/20
2008/0182645 A1 * 7/2008 Okada ..... G07F 17/3267 463/20
2008/0200238 A1 8/2008 Mishra
2009/0098933 A1 4/2009 Walker et al.
2010/0144422 A1 * 6/2010 Jackson ..... G07F 17/34 463/20
2013/0079098 A1 3/2013 Nicely et al.
2013/0079116 A1 3/2013 Nelson et al.

* cited by examiner

MATCHED SYMBOL UPGRADE SLOT GAME

BACKGROUND

The present disclosure relates to wager-based games and more particularly to slot games. The slot games may be played using gaming machines or in an online environment. A slot game typically has three or more mechanical reels which spin. Alternatively, a slot game may be shown on a video screen displaying simulated reels. The slot game may be activated when the player pushes a button, lever, or touches a touchscreen. The player is paid based on patterns of symbols visible on the reels when the reels stop.

SUMMARY

An exemplary embodiment relates to a method of providing game play of a wager-based game through a gaming machine having a controller. The method includes updating, by the controller, a display of the gaming machine to display a first grid and a second grid, wherein each of the first grid and the second grid showing a predetermined number of rows and a predetermined number of columns, the first grid comprising a plurality of grid spots, and the second grid comprising a plurality of grid spots. The method further includes determining, by the controller, a symbol for each grid spot in the first grid. The method further includes determining, by the controller, a symbol for each grid spot in the second grid. The method further includes updating, by the controller, the display of the gaming machine by updating the first grid and the second grid with the determined symbols. The method further includes determining, by the controller, that a first symbol in a first location in the first grid matches a second symbol in a second location in the second grid, wherein the first location and the second location are the same relative positions in the first grid and the second grid. The method further includes determining, by the controller, a first award to a player based on the determined match.

Another exemplary embodiment relates to an electronic device for playing a slot game. The electronic device includes a display configured to display the slot game to a player. The electronic device further includes a user-input device. The electronic device further includes a game controller having one or more data processors and one or more storage devices storing instructions that, when executed by the one or more data processors, cause the one or more data processors to perform operations comprising: updating a display of the gaming machine to display a first grid and a second grid, the first grid comprising a first plurality of grid spots, and the second grid comprising a second plurality of grid spots; determining a symbol for each grid spot in the first grid; determining a symbol for each grid spot in the second grid; updating the display of the gaming machine by updating the first grid and the second grid with the determined symbols; determining that a first symbol in a first location in the first grid matches a second symbol in a second location in the second grid, wherein the first location and the second location are the same relative positions in the first grid and the second grid; determining a first award to a player based on the determined match.

Yet another exemplary embodiment relates to a computer-readable storage medium having machine instructions stored therein, the instructions being executable by a processor to cause the processor to perform operations. The operations comprising updating a display of the gaming machine to display a first grid and a second grid, the first grid comprising a first plurality of grid spots, and the second grid comprising a second plurality of grid spots. The operations further comprising determining a symbol for each grid spot in the first grid. The operations further determining a symbol for each grid spot in the second grid. The operations further comprising updating, the display of the gaming machine by updating the first grid and the second grid with the determined symbols. The operations further comprising determining, by the controller, that a first symbol in a first location in the first grid matches a second symbol in a second location in the second grid, wherein the first location and the second location are the same relative positions in the first grid and the second grid. The operations further comprising determining, by the controller, a first award to a player based on the determined match.

BRIEF DESCRIPTION OF THE DRAWINGS

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

According to various embodiments disclosed herein, a slot game may display symbols in multiple outcome grids. The slot game may compare symbols in the same relative position in multiple outcome grids, looking for matches. The comparison may be performed for specific symbols or all symbols. When matches are found, an award may be provided to the player. The award may include an upgrade or modification of the matched symbols in one or more of the grids. The upgrades or modifications can take a variety of forms. For example, if a matched symbol in two or more grids is a wild symbol, the matched symbol in one or more of these grids may be upgraded to two wild symbols. In another example, the matched symbol in two or more grids may be updated or modified to another symbol (e.g., a wild symbol) in one or more of these grids. In another example, the matched symbol may be updated to a bonus triggering symbol.

Figure 1:
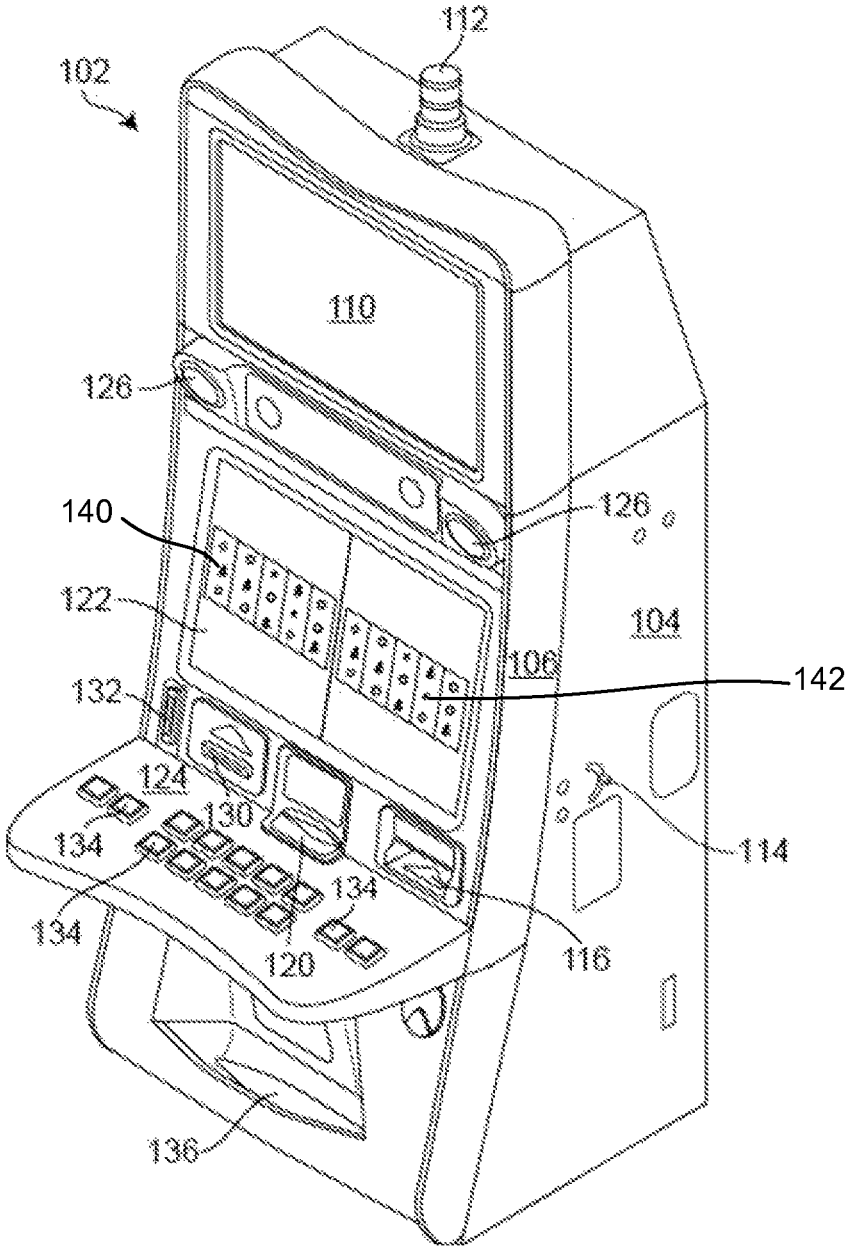
FIG. 1 is a perspective view of a gaming machine according to an exemplary embodiment.

Referring to FIG. 1, a gaming machine 102 is shown according to an exemplary embodiment. Gaming machine 102 includes a main cabinet 104. The main cabinet 104 may provide a secure enclosure that prevents tampering with device components, such as a game controller (not shown) located within the interior of the main cabinet 104. The main cabinet 104 may include an access mechanism, such as a door 106, which allows the interior of the gaming machine 102 to be accessed. Actuation of the door 106 may be controlled by a locking mechanism 114. In some embodiments, the locking mechanism 114, the door 106, and the interior of the main cabinet 104 may be monitored with security sensors of various types to detect whether the interior has been accessed. For instance, a light sensor may be provided within the main cabinet 104 to detect a change in light-levels when door 106 is opened and/or an accelerometer may be attached to the door 106 to detect when the door 106 is opened.

The gaming machine 102 may include any number of user interface devices that convey sensory information to a user and/or receive input from the user. For example, the gaming machine 102 may include a first electronic display 110, a second electronic display 122, speakers 126, and/or a candle device 112 to convey information to the user of gaming machine 102.

The display 122 is shown to include two grids 140 and 142. Although the two grids are shown side by side, the two grids can be shown in any other visual arrangement such as one grid being shown on top of another. The display 122 can display any number of grids to the player. For example, the display can show four grids, ten grids, or any other number of grids. In one implementation, each grid may comprise of multiple mechanical reels. In another implementation, each grid is shown on a visual display and the spinning of the reels associated with each grid is simulated. In another implementation, each grid consists of a plurality of spots, with each spot showing a symbol. For example, each grid may include five columns and four lines, with a total of twenty symbols being shown in the twenty spots on the grid. In this implementation, symbols for each spot on the grid are randomly or pseudo-randomly generated.

The gaming machine 102 includes a console 124 having one or more inputs 134 (e.g., buttons, track pads, etc.) configured to receive input from a user. A controller (not shown) within the gaming machine 102 may run a game, such as a wager-based game, in response to receiving input from a user via inputs 134 or displays 110, 122. For example, inputs 134 may be operated to place a wager in the game and to run the game. In response, the controller may cause reels shown on display 122 to spin, such as with a slot game, and/or display 110 to display the results of the game.

The gaming machine 102 may also include devices for conducting a wager-based game. For example, the gaming machine 102 may include a ticket acceptor 116 and a printer 120. In various embodiments, the gaming machine 102 may be configured to run on credits that may be redeemed for money and/or other forms of prizes. The ticket acceptor 116 may read an inserted ticket having one or more credits usable to play a game on the gaming machine 102. For example, the player of the gaming machine 102 may wager one or more credits within a video slot game. If the player loses, the wagered amount may be deducted from the player's remaining balance on the gaming machine 102. However, if the player wins, the player's balance may be increased by the amount won.

Any remaining credit balance on the gaming machine 102 may be converted into a ticket via a printer 120. For example, a player of the gaming machine 102 may cash out of the machine by selecting to print a ticket via the printer 120. The ticket may then be used to play other gaming machines or redeemed for cash and/or prizes. According to various embodiments, the gaming machine 102 may record data regarding its receipt and/or disbursement of credits. For example, the gaming machine 102 may generate accounting data whenever a result of a wager-based game is determined. In some embodiments, the gaming machine 102 may provide accounting data to a remote data collection device, allowing the remote monitoring of the gaming machine 102.

In one embodiment, the gaming machine 102 includes a loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 102. For example, a user having a loyalty account may be given a bonus turn on the gaming machine 102 or credited loyalty points for playing the gaming machine 102. Such loyalty points may be exchanged for loyalty rewards (e.g., a free meal, a free hotel stay, a free room upgrade, discounts, etc.).

In various embodiments, gaming machine 102 is a standalone computing device such as a desktop or laptop personal computer having at least one processor, memory device, display device and input device. The gaming machine in these embodiments is connected to a server. In various embodiments, gaming machine 102 is implemented on a mobile device, such as a tablet or smartphone, and connects to a server via a network such as internet to communicate with the server.

Figure 2A:
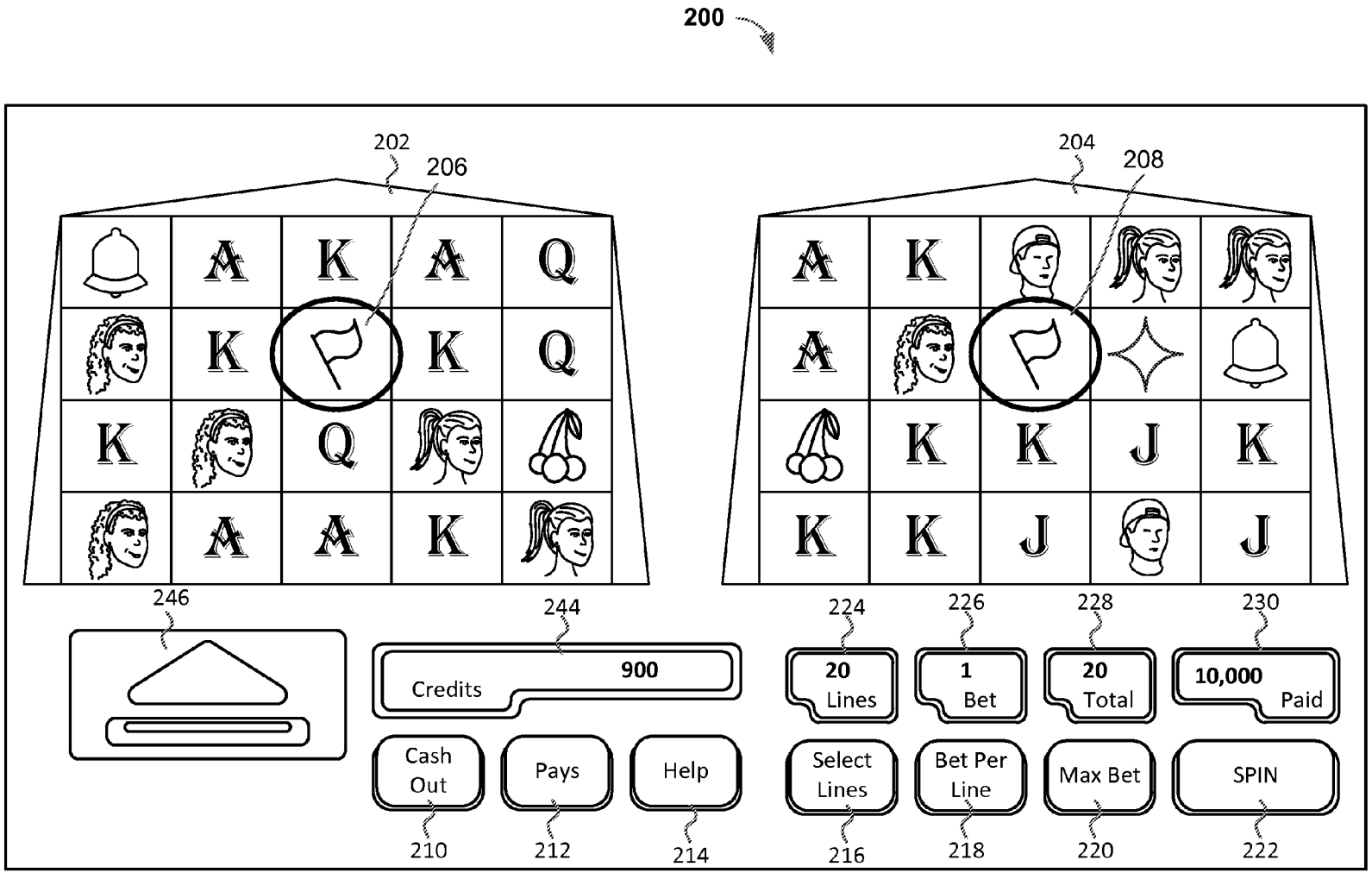
FIGS. 2A-B are illustrations of a slot game allowing for detection of matching symbols in the same relative positions in two grids according to an exemplary embodiment.
Figure 2B:
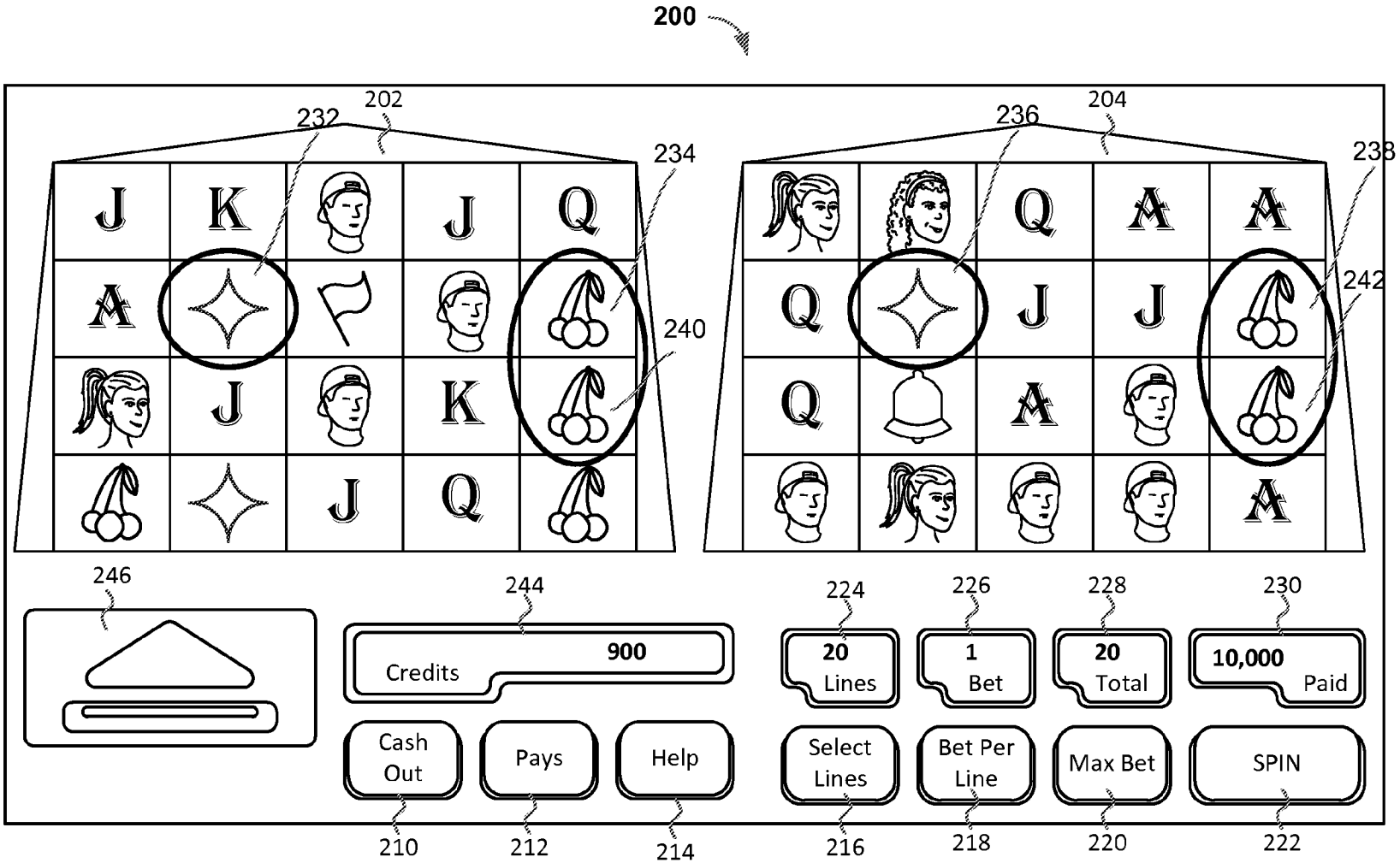

FIGS. 2A-B display a slot game 200 displaying two grids 202 and 204. Each of the grids displays twenty slots, with each slot displaying a symbol. As shown, the displayed symbols include letters and images of cherries, and people. Although a particular set of symbols is shown in the grids 202 and 204, any other symbols may be shown in the slot game grids. For example, the symbols shown in the grids may include various fruits (e.g., watermelon, apples, etc.), cartoon characters, movie characters, letters, theme characters, etc.

Each of the grids 202 and 204 are shown to include five reels. These reels may be virtual reels or mechanical reels. The gaming machine on which the slot game 200 is played provides various controls for the use to control the slot game 200. In particular, the controls include buttons 210-230 and 244. For example, by pressing the button 222, the player may request that the reels in the two outcome grids 202 and 204 to spin. By pressing the button 220, a maximum bet is wagered. The gaming machine requires that two separate wagers be placed, one for each grid, or outcome. The two wagers are usually identical in amount. A ticket or currency acceptor 246 may be used to purchase play on the gaming machine. The reels in grids 202 and 204 are spun simultaneously, or overlappingly and display two independent outcomes respectively.

After the reels are spun, the two grids display the symbols as shown in FIG. 2A. The slot game may compare the symbols in one or more positions on the grids 202 and 204 to determine if any of the symbols match in the same respective positions in the two grids. In one implementation, the slot game 200 compares the symbol in each slot in the grid 202 to the symbol in each corresponding slot in the grid 204. In this implementation, the slot game 200 may identify a match between a symbol shown in a slot 206 and a slot 208 shown in the same relative position in the grid 204. The slots 206 and 208 are in the same relative position in their respective grids. In particular, both slots are in the second row of the third reel. Both slots 206 and 208 display a flag symbol. Based on the comparison of symbols in the same relative positions in the two grids, the slot game 200 may determine that the only match is found in the slots 206 and 208. As shown, the matches are circled by the slot game 200.

In other implementations, the slot game 200 may search for matches for particular predetermined symbol(s). For example, the predetermined symbol may only include a flag symbol. In this example, the slot game may analyze the symbols shown in the grid 202, and only compare a symbol in the grid 202 to a symbol in the same relative position in the grid 204 when the symbol in the grid 202 is a flag. In other implementations, all the symbols are compared looking for matches. Yet in another implementation, only predetermined positions on the shown grids may be compared. For example, only the symbols shown in the first row may be compared for symbol matches.

Once the slot game 200 analyzes all the spots on the shown grids and identifies symbol matching in the same respective positions in the grids, an award or payout may be determined. As shown in FIG. 2A, the only identified symbol match is in slots 206 and 208. In one implementation, the award may involve upgrading one or both of the matched symbols. For example, if the two matched symbols are wild symbols (i.e., a wild symbol in first grid matches the position of the same wild symbol in the second grid), then the symbol in the first grid or the matching symbol in the second grid may be upgraded to a wild with a 2× multiplier (or any other multiplier value such as 3, 4, 5, etc.). This may be desirable for the user because a bonus or another feature may be triggered when two or more wild symbols are identified on a single grid. In another example, both of the matching symbols may be upgraded to multiple wild symbols. In another example, when the matching symbols on the two grids are not a wild symbol, one of them or both of them may be upgraded to the same or different wild symbol (or multiples of a wild symbol).

In other implementations, when bonus triggering symbols are displayed in matching positions in the two grids (or any number of multiple grids), their symbol count may be added towards triggering the bonus feature. For example, it may take two bonus symbols on the center reel for a bonus to be triggered. In this example, if the two bonus symbols in matching positions between the two grids had their count added to the count of total bonus triggering symbols, the bonus feature would be launched.

After reels are spun again (i.e., mechanically spun or using video simulation), FIG. 2B displays the grids 202 and 204 displaying symbols in different locations than in FIG. 2A. The slot game 200 may compare all the symbols (or specific symbols or specific grid locations) in matching positions on the two grids 202 and 204. As shown, the matches are circled by the slot game 200. In particular, slots 232 and 236 are located in matching positions (second slot in the second reel) on the grids 202 and 204, and each display a diamond symbol.

In addition, a cherries symbol is found in a slot 234 and a slot 238, as well as in a slot 240 and a slot 242. The slots 234 and 238 are located in the same positions in the grids 202 and 204 respectively, while the slots 240 and 242 are located in the same positions in the grids 202 and 204 respectively. The slots 234 and 240 are emphasized together with an oval to show that the symbols in those two slots match the slots 238 and 240 respectively, which are also emphasized together with an oval.

Although single oval is drawn around the slots 234 and 240, each of those slots may be emphasized to the player independently from one another. For example, a star may be drawn around the spots 234 and 238, and a rectangle may be drawn around the spots 240 and 243. The matches between the two grids are emphasized to the player by drawing circles and ovals around the matching slots on the two grids. However, different visualizations techniques (e.g., animation, background color of the slot, the colors of the symbol in the slots, etc.) other than circles or ovals may be used to emphasize to the player the detected matches between the grids.

Figure 3:
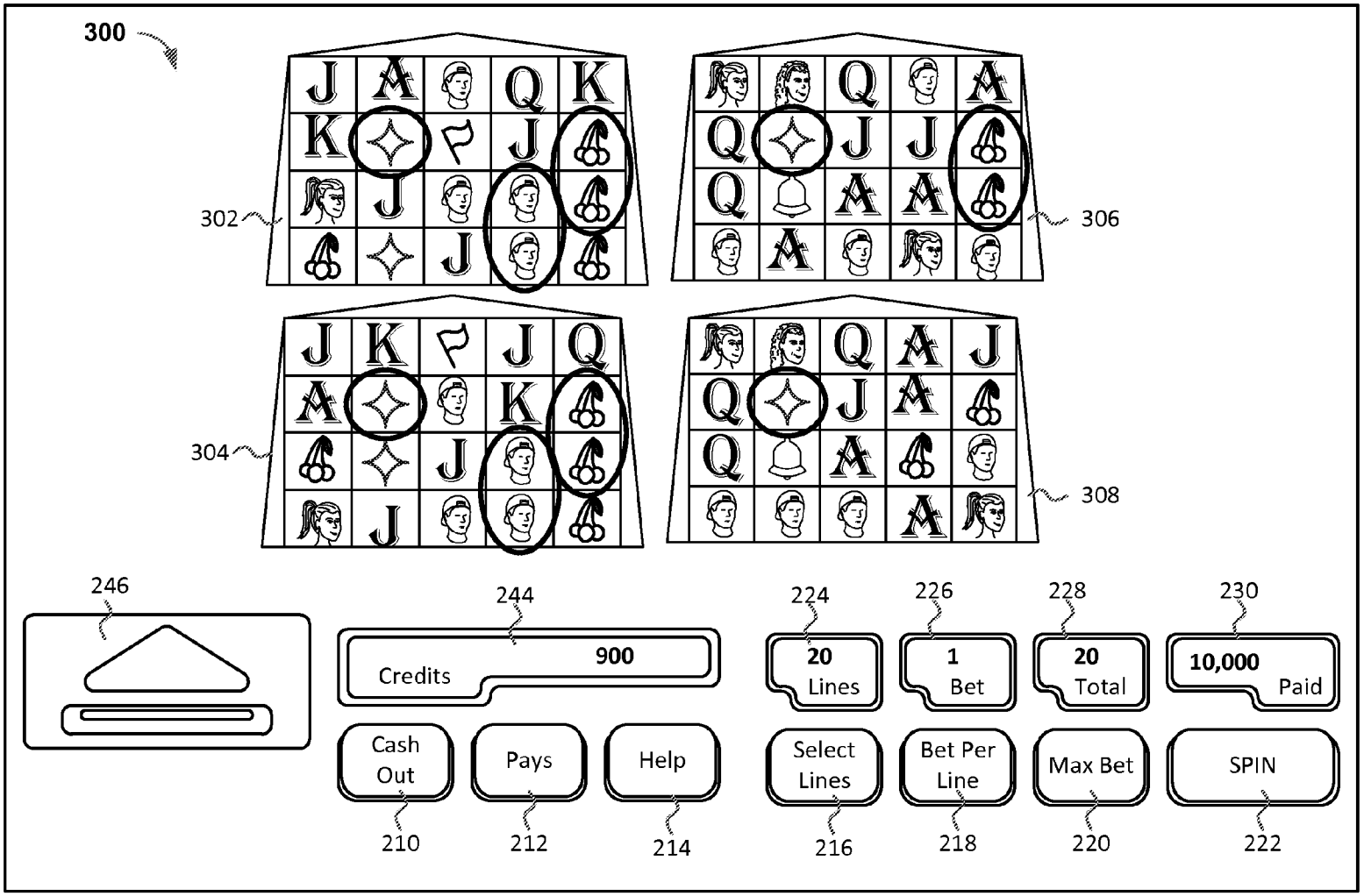
FIG. 3 is an illustration of a slot game allowing for detection of matching symbols in the same relative positions in four grids according to an exemplary embodiment.

Although FIGS. 2A-B displays two grids, any other number of grids may be shown during the slot game. For example, FIG. 3 provides an example of another slot game 300 during which four grids 302, 304, 306, 308 are shown. Each grid consists of five reels with each reel having four rows. The reels may be mechanical reels, or may be shown on a gaming machine display using video simulation. In another embodiment, the game may include visual simulation of four boards with each board having twenty spots, and each spot showing a symbol.

Slot game 300 allows the player to place a wager on one, two, three or all four of the slot grids and their corresponding outcomes. When the player places a wager on all four grids, the reels in each grid are spun independently of the reels in the other grids and display four independent outcomes. The slot game 300 may compare the symbols in the same respective positions in the four grids 302, 304, 306, and 308 and identify if any matching symbols are present. For example, one or more symbols may appear in the same location in two of the four grids, while one or more symbols may appear in the same location in three of the four grids, while one or more symbols may appear in the same location in all of the grids. The award provided to the player may depend on the number of grids in which a symbol is found in the same relative positions, and/or on the particular symbols themselves. In one implementation, matches for one symbol may carry more weight than matches found for another symbol. For example, a higher award may be given to the player when a diamond symbol is found in the same position on two of the grids, than when two letters "A" are found on the grids. For certain symbols, awards may only be provided when there is a match across a predetermined quantity of grids. For example, for the symbol "J", in order for the player to receive an award, the gaming system may require it to be present in at least three grids in the same relative position.

As shown, in FIG. 3, a diamond symbol is displayed in matching positions in all four grids 302, 304, 306, and 308. In particular, the second slot in the second reel in each of the grids 302, 304, 306, and 308 displays the diamond symbol. Thus, a matching symbol is identified that appears in the same respective location in all the four reels.

Furthermore, cherries symbols found in the second and third slots (i.e., in the second and the third row) of the fifth reel in the grids 302, 304, and 306 are identified as matches. Additionally, a "boy" symbol found in the third and fourth slots of the fourth reels in the grids 302 and 304 is also identified as a match.

In one implementation, the matched symbols may be upgraded to other symbols (e.g., wild symbols) in one or more grids. For example, the diamond symbol found in the four grids may be upgraded to a "queen" symbol in one or more of the four grids (e.g., in the grid 302). In another implementation, one, some or each of the matched symbols may be multiplied (e.g., instead of one symbol, two or more (e.g., three or four, etc.) of the same symbol are assigned to the spot) as part of a winning outcome evaluation. In another implementation, non-winning matched symbols may be modified to become winning symbols (e.g., into bonus triggering symbols). For example, if a "queen" symbol is a bonus triggering symbol, then the diamonds symbol found in the four grids may be modified to become the "queen" symbol.

In yet another implementation, when winning symbols (e.g., bonus triggering symbols) land in matching positions in two or more of the four grids, their symbol count may be added toward triggering a bonus feature. For example, if it takes two bonus symbols on the center reel for a bonus to be triggered, then the two bonus symbols in the matching positions between the grids may have their count added to the count of total bonus triggering symbols, and the bonus feature would be launched. In another implementation, the player may be given additional credits, additional paylines, free games, symbol upgrades or modifications, or any combination thereof, when symbol matches are found in the same relative positions in multiple grids as discussed herein.

In the case of four grids as shown in FIG. 3, when symbol matches are found between two grids, a different award may be provided to the player than if symbol matches are found between three grids. Similarly, when symbol matches are found between three grids, a different award may be provided to the player than if matches are found between all four grids. The award may be more substantial when matches are found between higher numbers of grids. The total number of identified matches may be used for calculating additional award or modifying the calculated award or payout.

Figure 4:
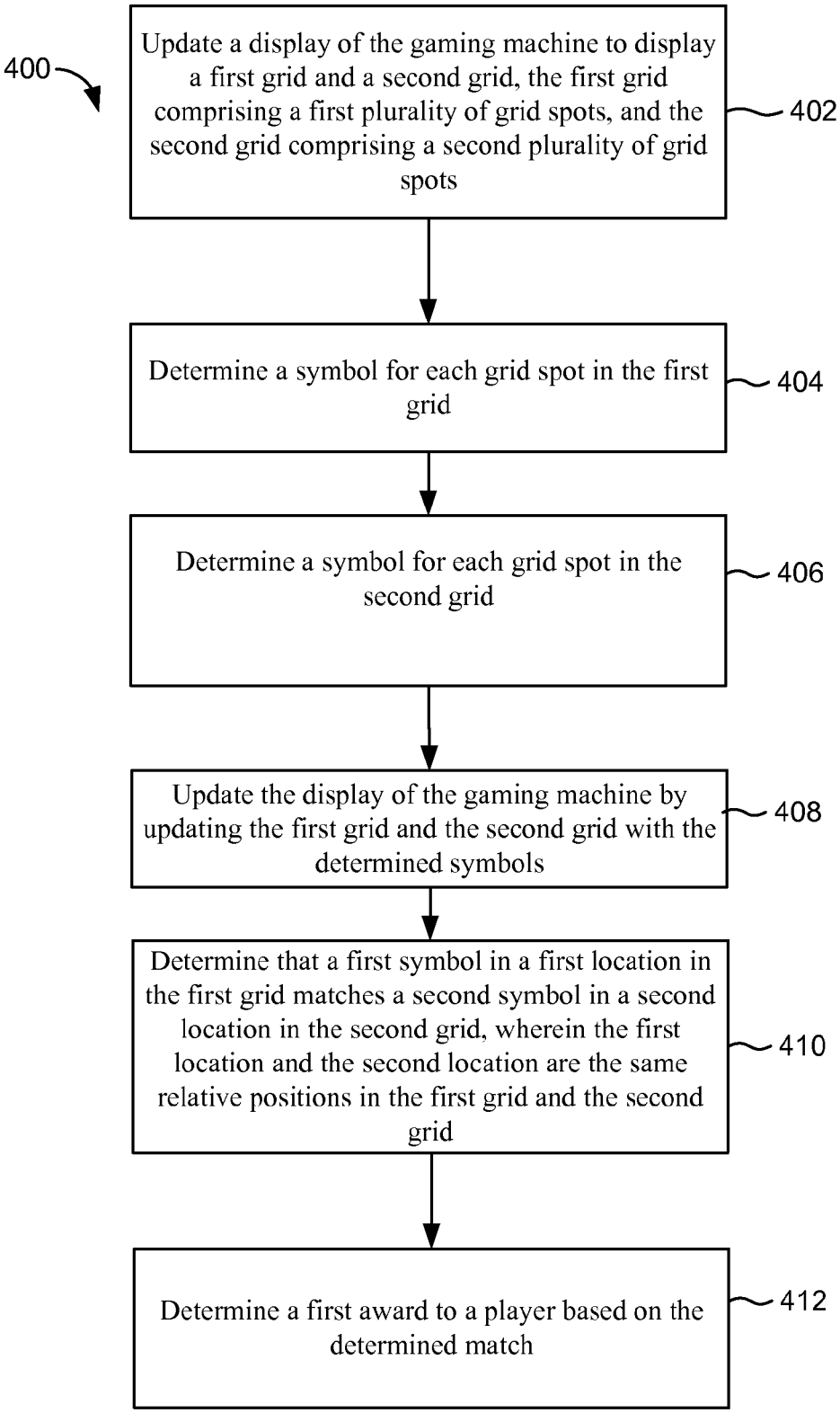
FIG. 4 is a flow diagram of a method of providing game play on a gaming machine according to an exemplary embodiment.

FIG. 4 is a flow diagram of a process 400 for providing a slot game that compares symbols in matching positions in multiple grids. The process 400 can be implemented on a computing device (e.g., a gaming machine, a user device, etc.). In one embodiment, the process 400 is encoded on a computer-readable medium that contains instructions that, when executed by the computing device, cause the computing device to perform operations of the process 400.

At block 402, a display of the gaming machine is updated to display a first grid and a second grid. The first grid may include a first plurality of grid spots, and the second grid may include a second plurality of grid spots. In one implementation, the two grids include the same number of spots (e.g., 20 spots). The grids may consist of multiple mechanical reels (e.g., five reels with four spots in each reel). If the grids are shown on a video display, then the spinning of the reels may be provided through a video simulation.

At block 404, a symbol for each grid spot in the first grid is determined. At block 406 a symbol for each grid spot in the second grid is determined. If the slot game includes mechanical reels, then those reels are spun to identify the symbols for display to the user. Alternatively, the symbols may be randomly selected from a list of available symbols or symbols assigned to each respective reel. The available symbols may be identical for each of the two grids. Each spot in the two grids may display a single symbol or an overlay of multiple symbols from a plurality of available symbols.

The display of the gaming machine is updated (block 408) by updating the first grid and the second grid with the determined symbols. For example, the determined symbols may be displayed on a video display. Alternatively, when mechanical reels stop spinning, the symbols that are visible are displayed to the player.

At block 410, it is determined that a first symbol in a first location in the first grid matches a second symbol in a second location in the second grid. The first location and the second location may be the same relative positions in the first grid and the second grid. For example, the first location may be the first spot in the second reel (or column) in the first grid, while the second location may be the first spot in the second reel (or column) in the second grid. In one implementation, specific symbols (e.g., only the flag symbols) or all the symbols in all the spots on the first grid may be compared to the symbols in the same relative spots on the second grids, looking for matches. The matches of symbols in the same locations may be shown to the player by using various visualization techniques. For example, the matching symbols may be circled as shown in FIG. 2A (i.e., a flag symbol shown in the spot 206 and the spot 208 are circled).

At block 412, upon determining that the first symbol matches the second symbol, a first award to a player is determined. The award may include any combination of upgrading the first symbol and/or the second symbol to another symbol (e.g., upgrading the symbol to a winning symbol), adding symbol count of the first and the second symbols together (e.g., to trigger a bonus feature), multiplying the first and/or the second symbol, etc. This award may be in addition to, or part of an award determined to the player to the outcome of the slot game in each of the two grids, based on a paytable for each slot game.

In various embodiments, the grids display a card game or a keno game instead of a slot type game to the player. When two cards of the card game across the two grids correspond, the player is provided an additional award in accordance with the various embodiments described above. Similarly, if two spots on the keno board are hit, the gaming machine may provide an additional award to the player.

Implementations of the subject matter and the operations described in this specification can be implemented in digital electronic circuitry, computer software, firmware or hardware, including the structures disclosed in this specification and their structural equivalents or in combinations of one or more of them. Implementations of the subject matter described in this specification can be implemented as one or more computer programs, i.e., one or more modules of computer program instructions, encoded on one or more computer storage medium for execution by, or to control the operation of data processing apparatus. Alternatively or in addition, the program instructions can be encoded on an artificially-generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client" or "server" includes a variety of apparatuses, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, a code that creates an execution environment for the computer program in question, e.g., a code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interlinked by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, or a portable storage device (e.g., a universal serial bus (USB) flash drive). Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well. For example, feedback provided to the user can be any form of sensory feedback, e.g., visual feedback, auditory feedback, or tactile feedback and input from the user can be received in any form, including acoustic, speech, or tactile input. In addition, a computer can interact with a user by sending documents to and receiving documents from a device that is used by the user. For example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interlinked by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown, in sequential order or that all illustrated operations be performed to achieve desirable results. In certain circumstances, multitasking and parallel processing may be advantageous. Moreover, the separation of various system components in the implementations described above should not be understood as requiring such separation in all implementations and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming machine, the method comprising:

(a) if a physical item is received via an acceptor of the gaming machine, establishing a credit balance based, at least in part, on a monetary value associated with the received physical item;

(b) after establishing the credit balance based, at least in part, on the monetary value associated with the received physical item:

(i) causing a display device of the gaming machine to display a first grid and a second grid of a play of a wager-based game, wherein:

(A) the first grid includes a first plurality of grid spots, (B) the second grid includes a second plurality of grid spots, (C) said first grid is displayed separate and distinct from the second grid, (D) the play of the wager-based game occurs following a placement of a wager, and (E) the placement of the wager causes a decrease of the credit balance;

(ii) causing at least one controller to execute a plurality of instructions to randomly determine a symbol for a plurality of the grid spots in the first grid;

(iii) causing the at least one controller to execute the plurality of instructions to randomly determine a symbol for a plurality of the grid spots in the second grid;

(iv) causing the display device of the gaming machine to display the first grid and the second grid with the randomly determined symbols;

(v) causing the at least one controller to execute the plurality of instructions to determine that a first randomly determined symbol in a first location in the first grid matches a second randomly determined symbol in a second location in the second grid, wherein the first location and the second location are the same relative positions in the first grid and the second grid; and (vi) if the match is determined, causing the at least one controller to execute the plurality of instructions to modify at least one of the matching first randomly determined symbol in the first location in the first grid and the second randomly determined symbol in the second location in the second grid; and (c) if a cashout input is received via a cashout device of the gaming machine, causing an initiation of any payout associated with the credit balance.

2. The method of claim 1, wherein the first plurality of grid spots and the second plurality of grid spots have a same number of spots.

3. The method of claim 1, which includes causing the at least one controller to execute the plurality of instructions to determine matching symbols in relative positions in the first grid and the second grid by comparing remaining symbols in the first grid to remaining symbols in the second grid in the same relative positions.

4. The method of claim 3, which includes, upon determining that one or more symbols in the first grid match symbols in the second grid in the same relative positions on the grid, causing the at least one controller to execute the plurality of instructions to determine an additional award.

5. The method of claim 4, wherein the additional award includes triggering a play of a bonus game.

6. The method of claim 1, wherein the spot displaying the first symbol is changed to display a third symbol and the spot displaying the second symbol is changed to display the third symbol.

7. The method of claim 6, wherein the third symbols shown in the first grid and the second grid trigger a play of a bonus game.

8. The method of claim 1, wherein the first symbol and the second symbol are each a wild symbol, and the modification includes upgrading the first symbol to a multiple of the first symbol, and upgrading the second symbol to a multiple of the second symbol.

9. The method of claim 1, wherein the first plurality of grid spots includes a first plurality of symbol display positions associated with a first plurality of reels and the second plurality of grid spots includes a second plurality of symbol display positions associated with a second, different plurality of reels.

10. An electronic gaming device, comprising:

a housing;

a display device supported by the housing;

a user-input panel supported by the housing, said plurality of input devices including:

(i) an acceptor, and (ii) a cashout device; and a game controller having at least one data processor and at least one storage device storing instructions that, when executed by the at least one processor, cause the at least one processor to:

(a) if a physical item is received via the acceptor, establish a credit balance based, at least in part, on a monetary value associated with the received physical item;

(b) after establishing the credit balance based, at least in part, on the monetary value associated with the received physical item:

(i) display a first grid and a second grid of a play of a game, the first grid including a first plurality of grid spots, and the second grid including a second plurality of grid spots, said first grid being displayed separate and distinct from the second grid;

(ii) randomly determine a symbol for a plurality of the grid spots in the first grid;

(iii) randomly determine a symbol for a plurality of the grid spots in the second grid;

(iv) display the first grid and the second grid with the randomly determined symbols;

(v) determine that a first randomly determined symbol in a first location in the first grid matches a second randomly determined symbol in a second location in the second grid, wherein the first location and the second location are the same relative positions in the first grid and the second grid; and (vi) if the match is determined, modify at least one of the matching first randomly determined symbol in the first location in the first grid and the second randomly determined symbol in the second location in the second grid; and (c) if a cashout input is received via the cashout device, cause an initiation of any payout associated with the credit balance.

11. The electronic gaming device of claim 10, wherein the first plurality of grid spots and the second plurality of grid spots have a same number of spots.

12. The electronic gaming device of claim 10, wherein when executed by the at least one processor, the instructions cause the at least one processor to determine matching symbols in relative positions in the first grid and the second grid by comparing remaining symbols in the first grid to remaining symbols in the second grid in the same relative positions.

13. The electronic gaming device of claim 12, wherein when executed by the at least one processor upon determining that one or more symbols in the first grid match symbols in the second grid in the same relative positions on the grid, the instructions cause the at least one processor to determine an additional award.

14. The electronic gaming device of claim 13, wherein the additional award includes triggering a play of a bonus game.

15. The electronic gaming device of claim 10, wherein the spot displaying the first symbol is changed to show a third symbol and the spot displaying the second symbol is changed to show the third symbol.

16. The electronic gaming device of claim 15, wherein the third symbols shown in the first grid and the second grid trigger a play of a bonus game.

17. The electronic gaming device of claim 10, wherein the first symbol and the second symbol are a wild symbol, and the modification includes an upgrade of the first symbol to a multiple of the first symbol, and an upgrade of the second symbol to a multiple of the second symbol.

18. The electronic gaming device of claim 10, wherein the first plurality of grid spots includes a first plurality of symbol display positions associated with a first plurality of reels and the second plurality of grid spots includes a second plurality of symbol display positions associated with a second, different plurality of reels.

19. A non-transitory computer-readable storage medium having machine instructions stored therein, the instructions being executable by a processor to cause the processor to:

(a) establish a credit balance if a physical item is received via an acceptor of a gaming machine, said established credit balance being based, at least in part, on a monetary value associated with the received physical item;

(b) after establishing the credit balance based, at least in part, on the monetary value associated with the received physical item:

(i) cause a display device of the gaming machine to display a first grid and a second grid, the first grid including a first plurality of grid spots, and the second grid including a second plurality of grid spots, said first grid being displayed separate and distinct from the second grid;

(ii) randomly determine a symbol for a plurality of the grid spots in the first grid;

(iii) randomly determine a symbol for a plurality of the grid spots in the second grid;

(iv) cause the display device of the gaming machine to display the first grid and the second grid with the randomly determined symbols;

(v) determine that a first randomly determined symbol in a first location in the first grid matches a second randomly determined symbol in a second location in the second grid, wherein the first location and the second location are the same relative positions in the first grid and the second grid; and (vi) if the match is determined, modify at least one of the matching first randomly determined symbol in the first location in the first grid and the second randomly determined symbol in the second location in the second grid, and (c) if a cashout input is received via a cashout device of the gaming machine, causing an initiation of any payout associated with the credit balance.

20. The non-transitory computer-readable storage medium of claim 19, wherein the first plurality of grid spots and the second plurality of grid spots have a same number of spots.

21. The non-transitory computer-readable storage medium of claim 19, wherein when executed by the processor, the instructions cause the processor to determine matching symbols in relative positions in the first grid and the second grid by comparing remaining symbols in the first grid to remaining symbols in the second grid in the same relative positions.

22. The non-transitory computer-readable storage medium of claim 21, wherein when executed by the processor upon determining that one or more symbols in the first grid match symbols in the second grid in the same relative positions on the grid, the instructions cause the processor to determine an additional award.

23. The non-transitory computer-readable storage medium of claim 19, wherein the first plurality of grid spots includes a first plurality of symbol display positions associated with a first plurality of reels and the second plurality of grid spots includes a second plurality of symbol display positions associated with a second, different plurality of reels.

* * * * *